US010746375B2

(12) United States Patent
Holopainen

(10) Patent No.: US 10,746,375 B2
(45) Date of Patent: Aug. 18, 2020

(54) LIGHTING ASSEMBLY

(71) Applicant: Teknoware Oy, Lahti (FI)

(72) Inventor: Aki Holopainen, Lahti (FI)

(73) Assignee: Teknoware Oy, Lahti (FI)

( * ) Notice: Subject to any disclaimer, the term of this patent is extended or adjusted under 35 U.S.C. 154(b) by 0 days.

(21) Appl. No.: 16/259,334

(22) Filed: Jan. 28, 2019

(65) Prior Publication Data

US 2019/0234584 A1 Aug. 1, 2019

(30) Foreign Application Priority Data

Jan. 30, 2018 (FI) ..... 20185079

(51) Int. Cl.
*F21V 7/09* (2006.01)
*F21V 7/00* (2006.01)
(Continued)

(52) U.S. Cl.
CPC ..... *F21V 7/0008* (2013.01); *F21S 8/02* (2013.01); *F21V 7/005* (2013.01); *F21V 7/05* (2013.01);
(Continued)

(58) Field of Classification Search
CPC ..... F21V 7/005
See application file for complete search history.

(56) References Cited

U.S. PATENT DOCUMENTS 3,270,194 A * 8/1966 Pui ..... F21V 7/0016 362/218
7,008,079 B2 3/2006 Smith
(Continued)

FOREIGN PATENT DOCUMENTS

DE 20 2011 003 261 U1 6/2011
EP 3 211 297 A1 8/2017
(Continued)

OTHER PUBLICATIONS

Finnish Search Report for corresponding Finnish Patent Application No. 20185079 dated Aug. 14, 2018, 2 pg.
(Continued)

*Primary Examiner* — Evan P Dzierzynski
*Assistant Examiner* — Keith G. Delahoussaye
(74) *Attorney, Agent, or Firm* — Merchant & Gould P.C.

(57) ABSTRACT

A lighting assembly comprising a housing (2), a lighting system and a reflector system. The housing (2) has a longitudinal direction, a lateral direction and a height direction which are perpendicular to each other. The lighting system is installed in the housing (2) and configured to produce light and emit the light out from the housing (2), the lighting system comprising a first light source (61). The reflector system is configured for reflecting the light produced by the lighting system out from the housing (2) and comprises a first reflector (41) including a first reflector surface (411) which is a concave surface with a first radius of curvature (r1). The first reflector (41) is also provided with a second reflector surface (412) which is a concave surface with a second radius of curvature (r2) which is larger than the first radius of curvature (r1), a centre of curvature (cc2) of the second reflector surface (412) being spaced from a centre of curvature (cc1) of the first reflector surface (411). The lighting assembly is configured to be such that most of the light emitted by the lighting system out from the housing (2) passes via the reflector system.

8 Claims, 2 Drawing Sheets

(51) Int. Cl.

| | |
|---|---|
| ***F21S 8/02*** | (2006.01) |
| ***F21V 7/05*** | (2006.01) |
| ***F21V 13/04*** | (2006.01) |
| *F21Y 115/10* | (2016.01) |
| *F21V 11/02* | (2006.01) |
| *F21Y 103/10* | (2016.01) |
| *F21Y 103/30* | (2016.01) |

(52) U.S. Cl.
CPC ..... *F21V 7/09* (2013.01); *F21V 13/04* (2013.01); *F21V 11/02* (2013.01); *F21Y 2103/10* (2016.08); *F21Y 2103/30* (2016.08); *F21Y 2115/10* (2016.08)

(56) References Cited

U.S. PATENT DOCUMENTS

| | | | | |
|---|---|---|---|---|
| 2004/0114366 | A1 | 6/2004 | Smith et al. | |
| 2007/0183053 | A1 | 8/2007 | Ellemor | |
| 2012/0008320 | A1 | 1/2012 | Tu et al. | |
| 2014/0226328 | A1 | 8/2014 | Schwarz | |
| 2014/0268692 | A1* | 9/2014 | Edmond | F21V 13/04 362/145 |
| 2014/0293594 | A1 | 10/2014 | Su | |

FOREIGN PATENT DOCUMENTS

| | | | |
|---|---|---|---|
| GB | 1 567 934 | A | 5/1980 |
| JP | H07-105917 | A | 4/1995 |
| JP | 2006-196405 | A | 7/2006 |
| JP | 2015-018627 | A | 1/2015 |
| WO | WO 2005/055328 | A1 | 6/2005 |

OTHER PUBLICATIONS

Extended European Search Report for European Patent Application No. 19153539.2 dated Apr. 29, 2019, 8 pages.

* cited by examiner

LIGHTING ASSEMBLY

This application claims benefit of Serial No. 20185079, filed 30 Jan. 2018 in Finland, and which application is incorporated herein by reference. To the extent appropriate, a claim of priority is made to the above disclosed application.

BACKGROUND OF THE INVENTION

The invention relates to a lighting assembly which comprises a lighting system installed in a housing and configured to produce light and emit the light out from the housing, and a reflector system configured for reflecting the light produced by the lighting system out from the housing.

It is known to produce a narrow light beam with a lighting assembly by using a suitable lens element. The known lens elements configured for producing a narrow light beam are relatively expensive.

SHORT DESCRIPTION OF THE INVENTION

The object of the invention is to provide a lighting assembly producing a narrow light beam without the known type of lens element.

The invention is based on the idea of providing the lighting assembly with a reflector having two concave surfaces, each having a different radius of curvature and being configured for producing a narrow light beam. The lighting assembly is configured to be such that most of the light emitted by the light source out from the housing passes via the reflector provided with the concave surfaces.

The advantage of the lighting assembly according to the invention is its simplicity and low manufacturing costs.

SHORT DESCRIPTION OF THE FIGURES

The invention will now be described in detail in the context of preferred embodiments, with reference to the accompanying drawings in which.

DETAILED DESCRIPTION OF THE INVENTION

Figure 1:
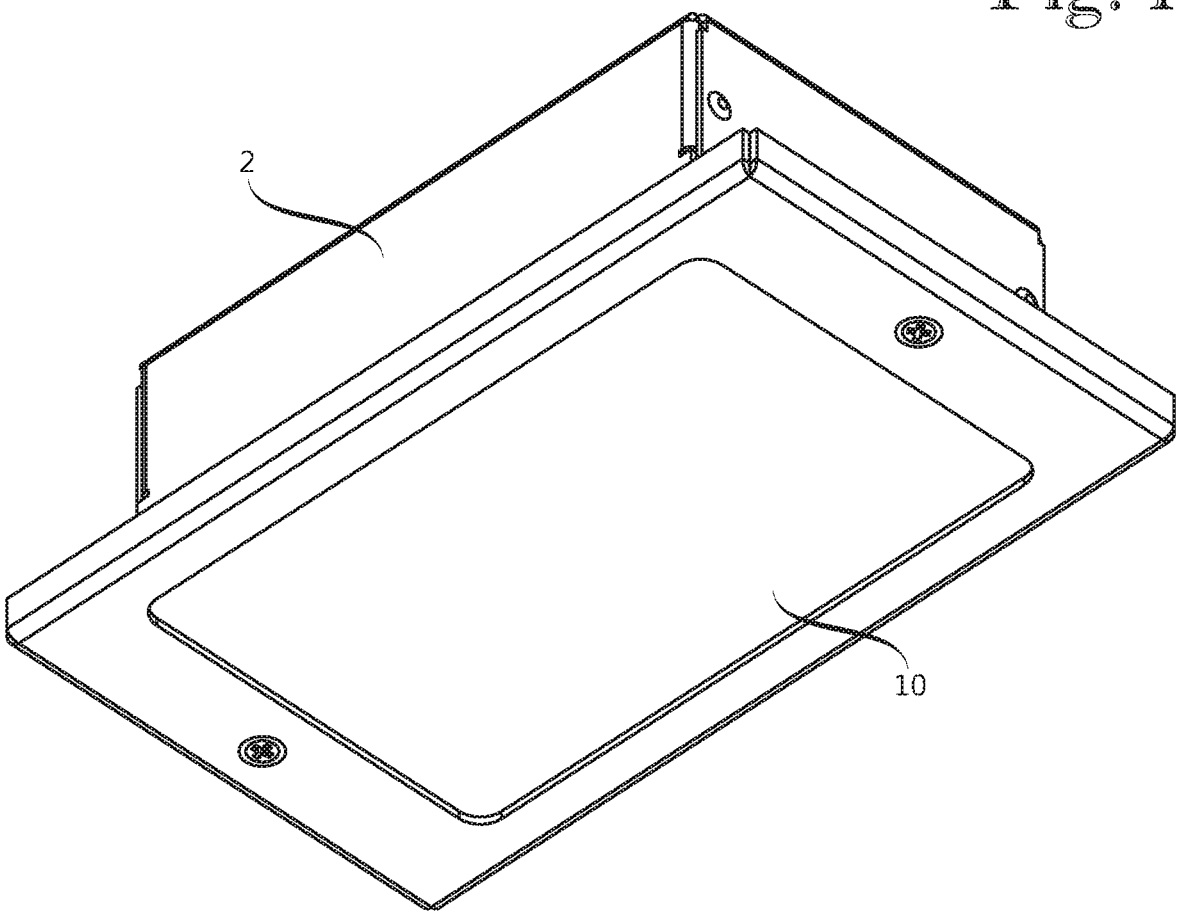
FIG. 1 shows a lighting assembly according to one embodiment of the invention.

FIG. 1 shows a lighting assembly which comprises a housing 2, a lighting system, a reflector system, a fin system, and a protection element 10. The housing 2 has a longitudinal direction, a lateral direction and a height direction which are perpendicular to each other. The longitudinal dimension of the housing 2 is greater than its lateral or height dimension.

Figure 2:
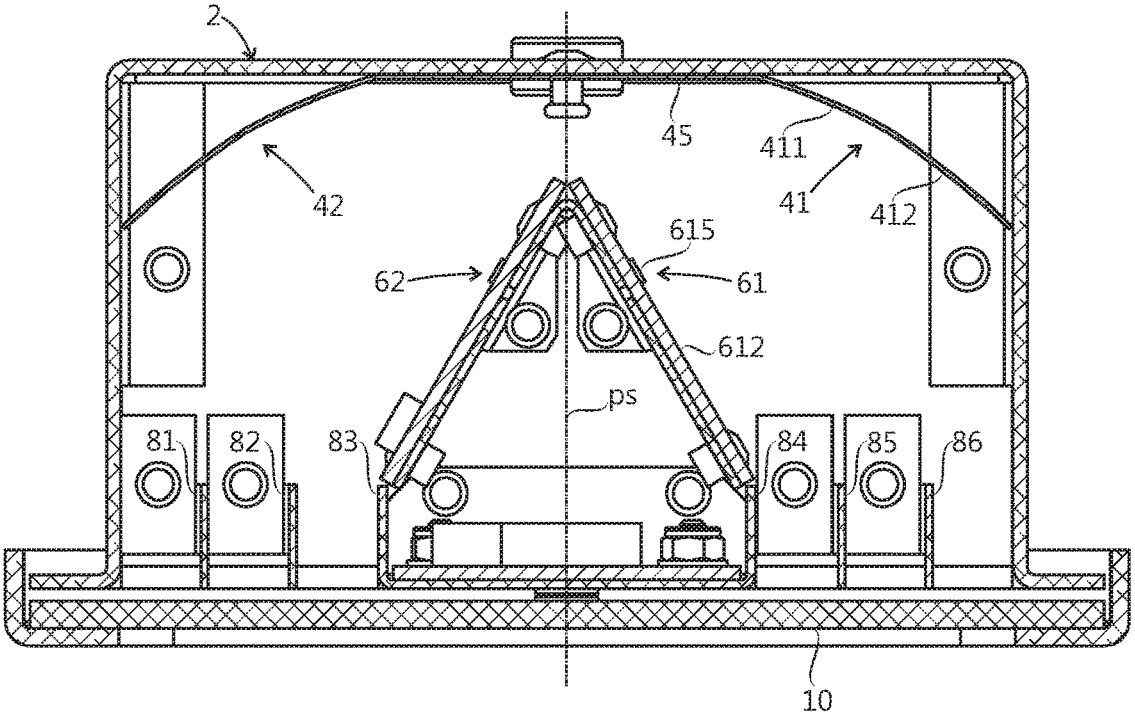
FIG. 2 shows a cross-section of the lighting assembly of FIG. 1.
Figure 3:
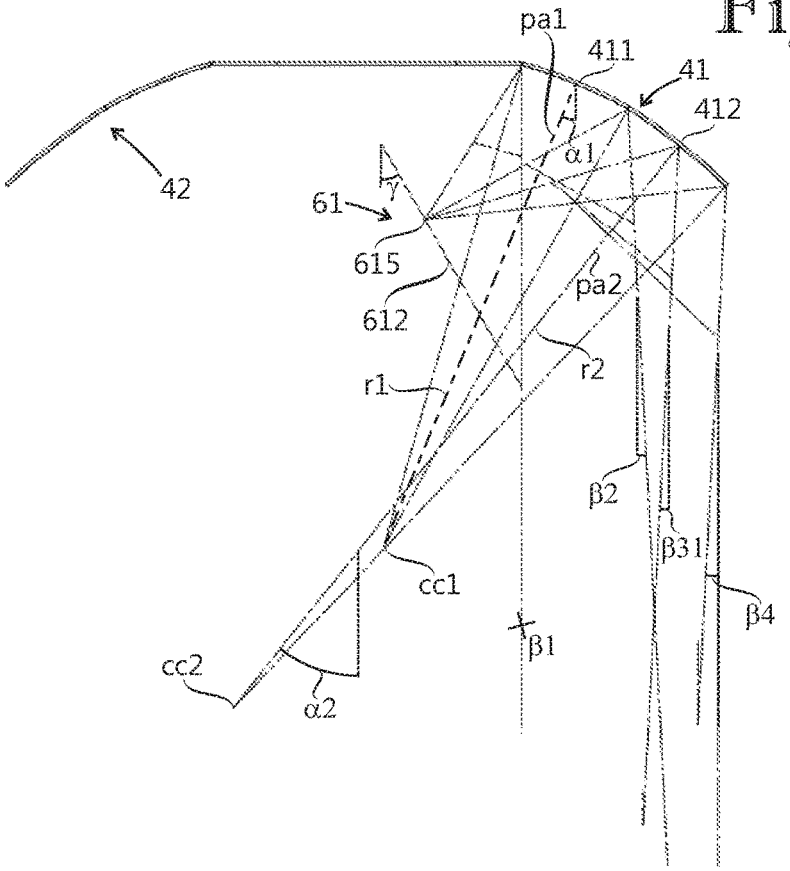
FIG. 3 illustrates the geometry of the lighting system and the reflector system in the lighting assembly of FIG. 1.

FIG. 2 shows a cross-section of the lighting assembly of FIG. 1. In FIG. 2 the longitudinal direction is perpendicular to the image plane. The geometrical features of the lighting assembly, such as various angles, are indicated in FIG. 3 only.

The lighting system is installed in the housing 2 and configured to produce light and emit the light out from the housing 2. The lighting system comprises a first light source 61 and a second light source 62.

The reflector system is configured for reflecting the light produced by the lighting system out from the housing 2 with a desired shape of light beam, without a separate lens element. The reflector system comprises a first reflector 41 and a second reflector 42 which are separated by a black and matt-surfaced antireflection surface 45.

The lighting assembly is configured to be such that substantially all of the light emitted by the lighting system out from the housing 2 passes via the reflector system. In this context, substantially all refers to a proportion of 95% or greater. In one alternative embodiment the lighting assembly is configured to be such that most of the light emitted by the lighting system out from the housing passes via the reflector system.

The fin system is configured to reduce lateral reflection of the light output from the lighting assembly. The fin system comprises six longitudinally extending fins denoted by 81-86. Each of the fins 81-86 is substantially an opaque and weakly reflective element located on the path of the ray of light output from the lighting system after the reflector system. Fins 81-83 are configured to reduce the lateral reflection of the light output from the second light source 62, and fins 84-86 are configured to reduce the lateral reflection of the light output from the first light source 61. The fins 81-86 are dark-painted aluminium elements.

In alternative embodiments the number of fins in the fin system is 4-8. The number of fins depends on the width of the lighting fixture, such that a fin system of a wide lighting fixture comprises more fins than that of a narrow lighting fixture.

The protection element 10 is translucent material and configured to protect the lighting system and the reflector system. The protection element 10 comprises a flat plate arranged perpendicular to the height direction. In one alternative embodiment the protection element is manufactured by co-extrusion, and the fin system is integrated with the protection element, such that the protection element is manufactured from translucent material and the fins are manufactured from opaque and weakly reflective material.

As seen in FIG. 2, the lighting assembly is symmetrical relative to a plane of symmetry ps. The longitudinal and height directions are parallel to the plane of symmetry ps, and the lateral direction is perpendicular to the plane of symmetry. The second light source 62 is geometrically a mirror image of the first light source 61 relative to the plane of symmetry ps. The second reflector 42 is geometrically a mirror image of the first reflector 41 relative to the plane of symmetry ps. In one alternative embodiment the lighting assembly only comprises the elements on the right side of the plane of symmetry ps of FIG. 2, i.e. the lighting assembly only comprises the first light source and the first reflector.

The first reflector 41 includes a first reflector surface 411 and a second reflector surface 412. The first reflector surface 411 is a concave surface with a first radius of curvature r1. The first radius of curvature r1 is substantially larger than the distance of the first light source 61 from the first reflector surface 411. Accordingly, the first radius of curvature r1 is also substantially larger than the distance of the centre of the first light source 61 from any point of the first reflector surface 411 as viewed in a plane perpendicular to the longitudinal direction.

The second reflector surface 412 is a concave surface with a second radius of curvature r2 which is larger than the first radius of curvature r1. A centre of curvature cc2 of the second reflector surface 412 is spaced from a centre of curvature cc1 of the first reflector surface 411. The second radius of curvature r2 is substantially larger than the distance of the first light source 61 from the second reflector surface 412.

The first radius of curvature r1 of the first reflector surface 411 is over 300% larger than the circumferential dimension of the first reflector surface 411, i.e. the distance from a first edge of the first reflector surface 411 to its second edge along the reflector surface. The second radius of curvature r2 of the second reflector surface 412 is over 400% larger than the circumferential dimension of the second reflector surface 412. The circumferential dimension of the second reflector surface 412 is larger than the circumferential dimension of the first reflector surface 411. In one alternative embodiment the first radius of curvature of the first reflector surface is over 100% larger than the circumferential dimension of the first reflector surface, and the second radius of curvature of the second reflector surface is over 150% larger than the circumferential dimension of the second reflector surface.

The first reflector surface 411 and the second reflector surface 412 are adjacent reflector surfaces. As viewed in the lateral direction, the first reflector surface 411 and the second reflector surface 412 are located on the same side of the first light source 61. The second reflector surface 412 is located in the lateral direction further away from the first light source 61 than the first reflector surface 411. The reflector comprising the first reflector 41 and the second reflector 42 in the reflector system is a solid element which is manufactured from one blank sheet material by bending. In an alternative embodiment the first reflector 41 is a solid element which is manufactured from one blank sheet material by bending.

A principal axis pa1 of the first reflector surface 411 is angled at a first principal axis angle $\alpha 1$ relative to the height direction, and a principal axis pa2 of the second reflector surface 412 is angled at a second principal axis angle $\alpha 2$ relative to the height direction. Both of the principal axis pa1 of the first reflector surface 411 and the principal axis pa2 of the second reflector surface 412 are inclined towards the first light source 61 with respect to the height direction. The first principal axis angle $\alpha 1$ is approximately 25°, and the second principal axis angle $\alpha 2$ is approximately 40°. In one alternative embodiment the first principal axis angle is 15°-35°, and the second principal axis angle is 30°-50°, such that the second principal axis angle is at least 10° larger than the first principal axis angle.

The first reflector surface 411 and the second reflector surface 412 of the first reflector 41 are located, with respect to the first light source 61, such that a ray of light output from the centre of the first light source 61 is reflected from a first edge of the first reflector surface 411 at a first reflection angle $\beta 1$ relative to the height direction, from a second edge of the first reflector surface 411 at a second reflection angle $\beta 2$ relative to the height direction, from the middle point between a first edge and a second edge of the second reflector surface 412 at a third reflection angle $\beta 31$ relative to the height direction, and from the second edge of the second reflector surface 412 at a fourth reflection angle $\beta 4$ relative to the height direction. The entire surface configured for reflecting light in the first reflector 41 is located between the first edge of the first reflector surface 411 and the second edge of the second reflector surface 412.

The first edge of each of the reflector surfaces 411 and 412 is located, in the lateral direction, closer to the first light source 61 than the second edge. The first edge and the second edge of each of the reflector surfaces 411 and 412 extend parallel to the longitudinal direction.

The first reflection angle $\beta 1$ is approximately 0°, the second reflection angle $\beta 2$ is directed approximately 3° outward, the third reflection angle $\beta 31$ and the fourth reflection angle $\beta 4$ are directed approximately 3° inward, the outward angle being directed away from the first light source 61, and the inward angle being directed toward the first light source 61.

The second edge of the first reflector surface 411 substantially coincides with the first edge of the second reflector surface 412, i.e. they are spaced by less than 3 mm. The small distance between the second edge of the first reflector surface 411 and the first edge of the second reflector surface 412 ensures that the smallest possible amount of light output from the first light source 61 falling on the boundary between the first reflector surface 411 and the second reflector surface 412 is absorbed or reflected in a wrong direction.

The small values of the reflection angles $\beta 1$, $\beta 2$, $\beta 31$ and $\beta 4$ produce a narrow light beam for the lighting assembly. In one alternative embodiment each of the first reflection angle, the second reflection angle, the third reflection angle and the fourth reflection angle is smaller than a threshold angle of reflection which is 0°-10°. In another alternative embodiment each of the first reflection angle, the second reflection angle, the third reflection angle and the fourth reflection angle is smaller than a threshold angle of reflection which is 0°-25°.

The first reflector 41 of the lighting assembly shown in FIG. 2 comprises exactly two concave reflector surfaces, i.e. the first reflector surface 411 and the second reflector surface 412. In alternative embodiments the first reflector may comprise three or more concave reflector surfaces.

The lighting system comprises a circuit board 612, and the first light source 61 comprises several LEDs 615 installed on the circuit board 612. The several LEDs 615 are installed in a row parallel to the longitudinal direction. The several LEDs 615 are white LEDs. In one alternative embodiment the first light source comprises coloured LEDs. In another alternative embodiment the first light source comprises both white and coloured LEDs.

The circuit board 612 defines a plane which is angled at a circuit board angle $\gamma$ relative to the height direction. The circuit board angle $\gamma$ is approximately 30°. The principal axis pa1 of the first reflector surface and the principal axis pa2 of the second reflector surface pass through the circuit board 612. The rays of light output from the centre of the first light source 61, which are reflected from the first edge of the first reflector surface 411, the second edge of the first reflector surface 411, the first edge of the second reflector surface 412, and the second edge of the second reflector surface 412, each bypass the circuit board 612 without touching it. In one alternative embodiment the circuit board angle is 20°-45°, and the principal axis of the first reflector surface passes through the circuit board.

It is obvious for a person skilled in the art that the basic idea of the invention may be implemented in many different ways. The invention and its embodiments are thus not limited to the above-described examples but may vary within the scope of the claims.

The invention claimed is:

1. A lighting assembly, wherein:

the lighting assembly comprises a housing having a longitudinal direction, a lateral direction and a height direction which are perpendicular to each other;

the lighting assembly comprises a lighting system which is installed in the housing and configured to produce light and emit the light out from the housing, the lighting system comprising a first light source;

the lighting assembly comprises a reflector system which is configured for reflecting the light produced by the lighting system out from the housing and comprises a first reflector including a first reflector surface which is a concave surface with a first radius of curvature, and a second reflector surface which is a concave surface with a second radius of curvature which is larger than the first radius of curvature, a center of curvature of the second reflector surface being spaced from a center of curvature of the first reflector surface;

the lighting assembly is configured to direct most of the light emitted by the lighting system out from the housing passes via the reflector system;

the first reflector surface and the second reflector surface are adjacent reflector surfaces, of which the second reflector surface is located in the lateral direction further away from the first light source than the first reflector surface; and the first reflector surface and the second reflector surface of the first reflector are located, with respect to the first light source, such that a ray of light output from the center of the first light source is reflected from a first edge of the first reflector surface at a first reflection angle relative to the height direction, from a second edge of the first reflector surface at a second reflection angle relative to the height direction, from the middle point between a first edge and a second edge of the second reflector surface at a third reflection angle relative to the height direction, and from the second edge of the second reflector surface at a fourth reflection angle relative to the height direction, wherein each of the first reflection angle, the second reflection angle, the third reflection angle and the fourth reflection angle is smaller than a threshold angle of reflection which is 0°-10°.

2. The lighting assembly according to claim 1, wherein a principal axis of the first reflector surface is angled at a first principal axis angle relative to the height direction, and a principal axis of the second reflector surface is angled at a second principal axis angle relative to the height direction, both of the principal axis of the first reflector surface and the principle axis of the second reflector surface being inclined towards the first light source with respect to the height direction.

3. The lighting assembly according to claim 2, wherein the first principal axis angle is 15°-35°, and the second principal axis angle is 30°-50°.

4. The lighting assembly according to claim 2, wherein the second principal axis angle is at least 10° larger than the first principal axis angle.

5. The lighting assembly according to claim 1, wherein the first radius of curvature is larger than the distance of the first light source from the first reflector surface.

6. The lighting assembly according to claim 1, wherein the lighting system comprises a circuit board, and the first light source comprises several LEDs installed on the circuit board, the circuit board being located such that a plane defined by the circuit board is angled at a circuit board angle relative to the height direction, the circuit board angle being 20°-45°, and the principal axis of the first reflector surface passes through the circuit board.

7. The lighting assembly according to claim 1, wherein the lighting assembly comprises a fin system which is configured to reduce lateral reflection of the light output from the lighting assembly, the fin system comprising several longitudinally extending fins which are each opaque and weakly reflective elements located on the path of the ray of light output from the lighting system after the reflector system.

8. The lighting assembly according to claim 1, wherein the lighting assembly is configured to be such that substantially all of the light emitted by the lighting system out from the housing passes via the reflector system.

* * * * *